US012384641B1

(12) United States Patent
Duncan

(10) Patent No.: US 12,384,641 B1
(45) **Date of Patent: *Aug. 12, 2025**

(54) AUTOMATIC SLEEVING SPLICER COMPRISING MOVING UPPER AND/OR LOWER TAPE HEADS

(71) Applicant: Elisa M. Duncan, Apex, NC (US)

(72) Inventor: Elisa M. Duncan, Apex, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/971,976

(22) Filed: Dec. 6, 2024

(51) Int. Cl.
*B65H 19/20* (2006.01)
*B65H 19/10* (2006.01)

(52) U.S. Cl.
CPC ..... *B65H 19/20* (2013.01); *B65H 19/102* (2013.01); *B65H 2301/4607* (2013.01); *B65H 2301/4621* (2013.01); *B65H 2301/4631* (2013.01); *B65H 2301/4641* (2013.01); *B65H 2701/1944* (2013.01)

(58) Field of Classification Search
None
See application file for complete search history.

(56) References Cited

U.S. PATENT DOCUMENTS 3,654,035 A 4/1972 Takimoto
3,836,089 A 9/1974 Rimersma
3,939,031 A 2/1976 Takimoto
4,106,974 A 8/1978 Hirsch
4,190,475 A 2/1980 Marschke
4,331,301 A 5/1982 Martinez
6,082,661 A 7/2000 Mutschall
11,745,970 B1 * 9/2023 Duncan ..... B65H 19/1852 156/504
2004/0084133 A1 5/2004 Adami
2004/0084561 A1 5/2004 Clifford
2004/0149853 A1 8/2004 Fairchild
2007/0044898 A1 3/2007 Hikita
2015/0047772 A1 2/2015 Van Heck
2017/0137248 A1 * 5/2017 Sato ..... B65H 19/102
2017/0369265 A1 * 12/2017 Murgia Mendizabal ..... B65B 41/12
2018/0162668 A1 6/2018 Hong

* cited by examiner

*Primary Examiner* — William A. Rivera

(74) *Attorney, Agent, or Firm* — Ashley D. Johnson; Dogwood Patent and Trademark Law

(57) ABSTRACT

An apparatus and method for automatic splicing of rolls of sleeve material used in various packaging applications. The disclosed system will automatically splice the leading end of a new roll onto the trailing end of the old roll in an overlapped configuration. The apparatus performs an automatic cut and splice operation resulting in a splice of the two film rolls with tape applied to both sides of the splice joint where the new roll overlaps the cut end of the prior roll.

15 Claims, 11 Drawing Sheets

AUTOMATIC SLEEVING SPLICER COMPRISING MOVING UPPER AND/OR LOWER TAPE HEADS

TECHNICAL FIELD

The presently disclosed subject matter relates generally to an automatic sleeving splicer apparatus comprising moving upper and/or lower tape heads. The presently disclosed subject matter also includes methods of making and using the disclosed splicing apparatus.

BACKGROUND

In the manufacturing field, shrink sleeve applicators are used to cut sections of thermoplastic film and apply the cut film onto various types of products. As heat is applied to the film, it contracts and conforms to the shape of an associated product (e.g., often in the form of a tamper-evident band and/or decorative sleeve). Generally, conventional shrink sleeve applicators employ film sourced from a running web roll that is currently in use and a ready web roll that provides a source of web once the running web roll expires. When the running roll is about to expire, the shrink sleeve applicator typically stops running to allow the roll of film to be changed. A spliced segment of the running web is then separated from the substantially empty roll core and the ready web is brought up to line speed. The physical splice between a trailing edge of an outgoing running web and a leading edge of a replacement ready web can be completed using various methods. For example, a butt splice is often used, wherein the trailing edge of the depleted running web roll and the leading edge of the ready web roll are abutted against one another and joined. The joining of the two edges is typically accomplished with an adhesive tape applied to a top and bottom edge of the abutment. However, the formation of a butt splice can be difficult, requiring stopped machinery and/or a high degree of precision and accuracy. Specifically, an improper butt splice can lead to a gap between the two edges of web material, leaving exposed adhesive, which may cause problems as the gap and exposed adhesive proceed through the associated machinery or equipment. It would therefore be beneficial to provide a web splicing apparatus that overcomes the shortcomings of the prior art, allowing the ready film roll to be spliced into the running web without stopping production of the shrink sleeve applicator.

SUMMARY

In some embodiments, the presently disclosed subject matter is directed to a tubular film splicing apparatus. Specifically, the apparatus is defined by an upper tape head comprising a front face and a lower tape head comprising a front face. The front face of both the upper and lower tape heads includes an attachment element. The apparatus includes an opening positioned between the upper and lower tape heads. The apparatus further includes a cutting element. The upper tape head and/or the lower tape head (e.g., the upper tape head only, the lower tape head only, or both the upper and lower tape heads) move between a first orientation in which the upper tape head and/or lower tape head front faces extend in a first direction, and a second orientation in which the upper tape head and/or lower tape head front faces are positioned to face each other. Alternatively, the tape heads can be rotated and/or configured to move in any desired direction to apply tape onto a film, as discussed in detail below. The upper tape head and the lower tape head move. For example, the upper tape head and lower tape head can independently move to meet, applying a splice as described in detail below.

In some embodiments, the cutting element is selected from a knife, blade, or laser.

In some embodiments, attachment elements positioned on the front face of the upper tape head and the front face of the lower tape head comprise vacuum suction. Alternatively, the front face of the tape heads can utilize an adhesive surface and/or mechanical clips to hold the tape in place.

In some embodiments, the apparatus includes an actuator to provide the movement of the upper and/or lower tape heads.

In some embodiments, the upper and/or lower tape heads move or rotate about 90 degrees.

In some embodiments, the apparatus comprises a shuttle configured to move between a first set of upper and lower tape heads and a secondary set of upper and lower tape heads. In some embodiments, the first and second set of upper and lower tape heads are arranged in a horizontal or vertical configuration.

In some embodiments, the presently disclosed subject matter is directed to a method of creating an overlapping joint of two tubular films. Specifically, the method comprises positioning a first portion of tape defined by an adhesive side and a non-adhesive side on the front face of the upper tape head such that the non-adhesive side contacts the front face of the upper tape head of a tubular film splicing apparatus.

The disclosed apparatus comprises an upper tape head comprising a front face and a lower tape head comprising a front face. The front face of both the upper and lower tape heads can include an adhesive region. The apparatus includes an opening positioned between the upper and lower tape heads. The apparatus further includes a cutting element.

The upper tape head or the lower tape head moves between a first orientation in which the moving tape head front face extends in a first direction, and a second orientation in which the moving tape head moves.

The method includes positioning a second portion of tape defined by an adhesive side and a non-adhesive side on the front face of the lower tape head such that the non-adhesive side contacts the front face of the lower tape head. The method further includes feeding a leading edge of a first tubular film through the opening between the upper and lower tape heads. The method includes cutting the leading edge of the first tubular film using the cutting element as applied by the operator to create an upper portion of film and a lower portion of film either before or after feeding the first tubular film through the opening. The method comprises advancing the upper portion of film and lower portion of film of the first tubular film between the first and second tape heads such that the upper portion of film contacts the adhesive side of the first portion of tape and the lower portion of film contacts the adhesive side of the second portion of tape. The method comprises positioning the trailing edge of a second tubular film in alignment with the first tubular film. The method comprises moving the front faces of the upper or lower tape heads from the first orientation to the second orientation, whereby the adhesive side of the first portion of tape is adhered to a top face of the second tubular film and the adhesive side of the second portion of tape is adhered to a bottom face of the second tubular film. The first tubular film and second tubular film are spliced via an overlapping joint wherein the trailing edge of the second tubular film is aligned within an interior of the first tubular film.

In some embodiments, the tubular film splicing apparatus is used with shrink sleeve applicator machinery, and wherein the machinery continues to run while the overlapping joint is created.

In some embodiments, the first tubular film is a new roll of a film and the second roll of film is an expiring roll of film.

In some embodiments, the first tubular film and the second tubular film are shrink films.

In some embodiments, the first tubular film and the second tubular film are multilayer polymeric films.

In some embodiments, the method comprises using a shuttle to position the trailing edge of the second tubular film between a first set of upper and lower tape heads and a second set of upper and lower tape heads.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

Figure 1:
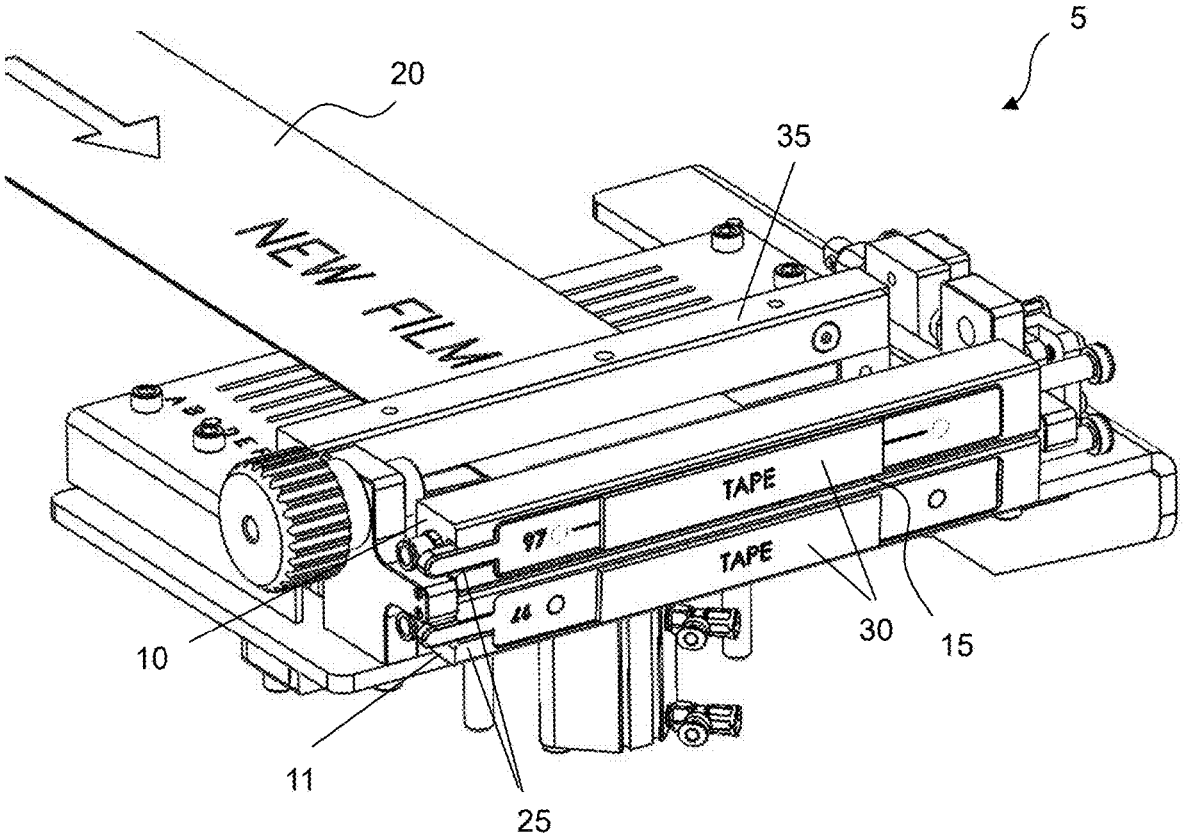
FIG. 1 is a perspective view of a splicer head in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

The presently disclosed subject matter is directed to an automatic splicing apparatus for use in splicing tubular webs. The disclosed apparatus is configured to splice two rolls of tubular web together, enabling the associated shrink sleeve applicator machinery to continue running without stopping the machine from operating. Importantly, the disclosed apparatus creates an overlapping joint of the tubular films from each roll. Specifically, the trailing edge of the running film roll ("the old film") is aligned inside the ready film roll ("the new film") at the leading edge, creating an "old inside new" arrangement, as discussed in detail below. Adhesive tape (or any other suitable securing element) is applied on each side of the spliced film at the joint between the new and old films. Thus, the disclosed splicing apparatus is configured to provide a non-stop supply of film material to downstream application systems using a unique and beneficial overlapped arrangement.

The disclosed splicing apparatus is designed to operate in the framework of an unwinding device for supplying a web material to a shrink sleeve applicator machine that uses it (not illustrated) constituted typically by one of the workstations of a manufacturing plant. Such applications are well known in the art as described in U.S. Pat. Nos. 9,637,340; 10,457,512; 11,447,356; and 2017/00190452, the entire contents of which are incorporated by reference herein. However, it should be appreciated that even though the disclosed invention has been developed with particular attention paid to this possible field of application, the scope of the invention itself is not in itself limited to shrink sleeve applicators and can be used in any packaging market.

The disclosed web splicing apparatus is typically used in an environment comprising an old roll of film and a new roll of film that are intended to be spliced together. Specifically, the old roll is currently being fed and the new roll will be spliced into operation. The term "old roll" refers to the roll of tubular film currently in use that will be expiring as the amount of film present is used. The term "new roll" refers to the most recently loaded roll of tubular film comprising a leading edge onto which the trailing end of the old roll of film will be joined. The term "leading edge" refers to the most forward edge with respect to the direction of travel. The term "trailing edge" refers to the edge opposite to the leading edge with respect to the direction of travel. The term "splice" refers to the act or result of joining the trailing end of the old film roll with the leading edge of the new film roll to form a continuous web. Thus, the web unwound from the old roll represents the web in use, while the web from the new roll is spliced to the old roll before the exhaustion of the latter.

In use, the old film roll and new film roll can generally be moved through the splicer and/or associated machinery by a series of motorized rollers. The old and new films can generally have a flattened and tubular shape with a thickness suitable for being fed through the splicer 5. At a trailing edge, the outgoing web can be spliced with a leading edge of a replacement web from the new roll to continue the unwinding process. For example, in an unwinding process, when the old roll containing outgoing web is depleted or nearly depleted, a trailing edge of the outgoing web can be spliced with a leading edge of the replacement web, such that the replacement web can continue feeding the unwinder. The replacement web is typically the same or a similar material as the outgoing web.

The term "web" or "film" refers to a thin ribbon of tubular and flexible material, such as (but not limited to) polymeric shrink film. The term "tubular film" refers to a film formed into a cylindrical and flat tube shape that is wound on a roll for storage. Thus, the tubular film has an inner and outer face versus being a single layer of material. The term "shrink film" refers to any polymer film material that can be shrunk to fit around and secure one or more items. Without being bound by theory, shrinkage may occur due to relaxation of the orientation stresses of the plastics during the shrink process. Typically, the shrink film application machinery opens the film using associated tooling, which can be problematic if butt splices are present (e.g., the tape can stick together, catching the tooling and stopping production).

The tubular film can be a single layer or multilayer film produced by any suitable method, such as coextrusion of a blown film. However, any method can be used to create the tubular film.

FIG. 1 illustrates one embodiment of splice apparatus 5 that accomplishes the disclosed splicing operation. The splicer comprises stacked upper and lower tape heads 10, 11 with central opening 15 that passes between the tape heads. As shown, each tape head can be configured as a bar (e.g., rectangular bar), each with a portion of adhesive material (such as tape 30). The central opening thus runs the entire length of the distance between the tape heads. A retention element (such as a pneumatic clamp, vacuum, or any other suitable element) can be used to hold the adhesive material in place and to prevent movement before and during splicing. For example, a vacuum, an adhesive region, and/or mechanical clips can be used. Each tape head includes front face 25 that is configured to rotate and/or move from a first position (illustrated in FIG. 1) to a second position where at least one (or only one) tape head front face is moved or rotated relative to the other tape head to achieve the splicing operation, as discussed in detail below. Any method can be used to enable rotation or movement of the upper and lower tape heads, such as the use of an actuator.

An adhesive material (e.g., adhesive tape 30) is used to couple together the new and old films during a splicing event. The adhesive material can include an adhesive side and non-adhesive side. The adhesive side includes one or more adhesive materials (e.g., one or more materials that are capable of bonding and/or attaching to a film). Suitable adhesives can include (but are not limited to) pressure-sensitive adhesives (e.g., styrenic polymer, polyisobutylene, polyacrylate-based or poly-isobutylene based adhesives, rubber-based adhesives), synthetic adhesives, natural adhesives (e.g., derived from natural materials or polymers), or combinations thereof. However, the adhesives are not limited, and any desired adhesive(s) can be used. "Non-adhesive" refers to the characteristic of not appreciably adhering to or bonding to a film.

Figure 2:
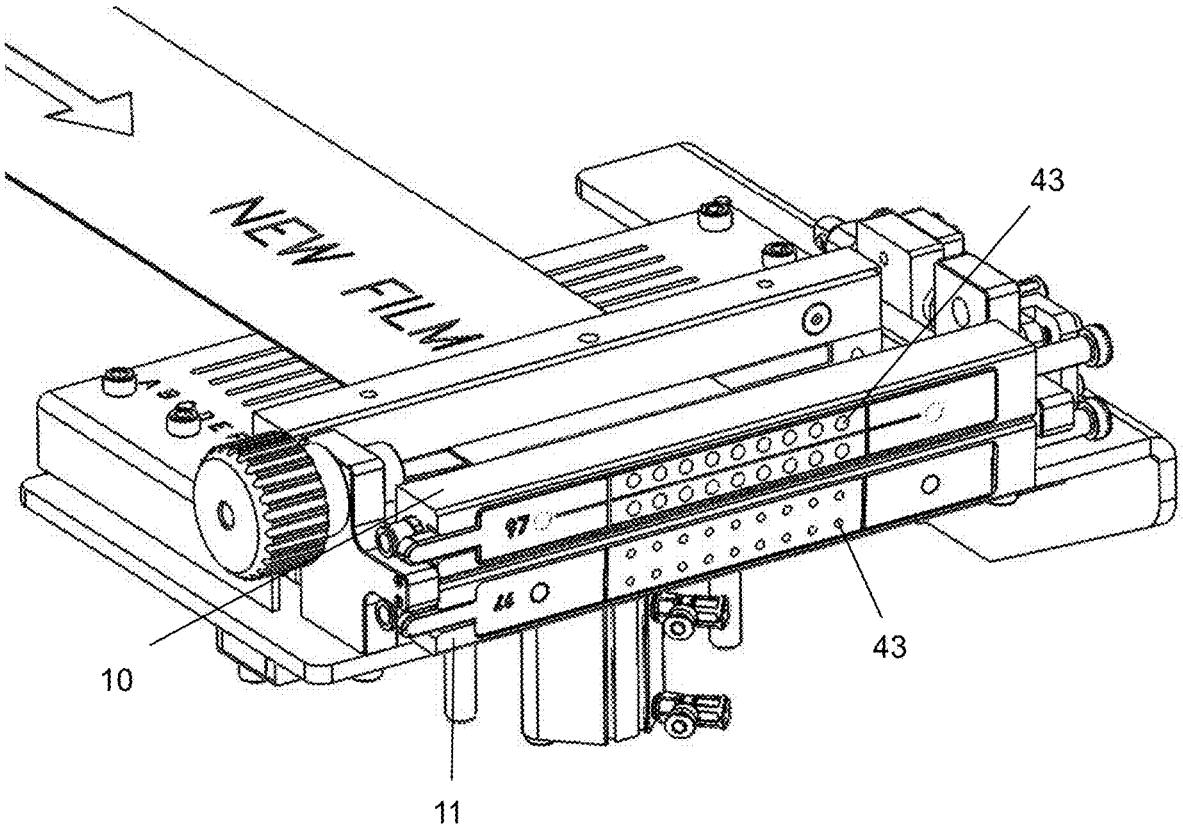
FIG. 2 is a perspective view of a splicer head comprising vacuum apertures in accordance with some embodiments of the presently disclosed subject matter.

The adhesive side of tape 30 is intended to contact the films at the splice joint to hold the old and new films together. In some embodiments, an operator can manually position the non-adhesive side of each piece of tape on an upper and lower tape head. The non-adhesive side that is held against front face 25 of each of the upper and lower tape heads until the adhesive strip is positioned over the webs. In some embodiments, the front face of tape heads 10, 11 can employ a vacuum suction to hold the non-adhesive side of the adhesive strip against the corresponding tape head front faces 25, as illustrated in FIG. 2. Specifically, upper and lower tape heads 10, 11, can each comprise a series of apertures 43 that are in fluid connection with a vacuum source. As the vacuum is activated, negative pressure is created to hold the adhesive material (e.g., tape 30) to the front face of the upper and lower tape heads. The vacuum can be positioned within the interior of the hollow manifold or at any desired location. Correspondingly, the adhesive side of the tape faces outward to be properly positioned for adhesion to the films during the splicing operation.

Figure 3A:
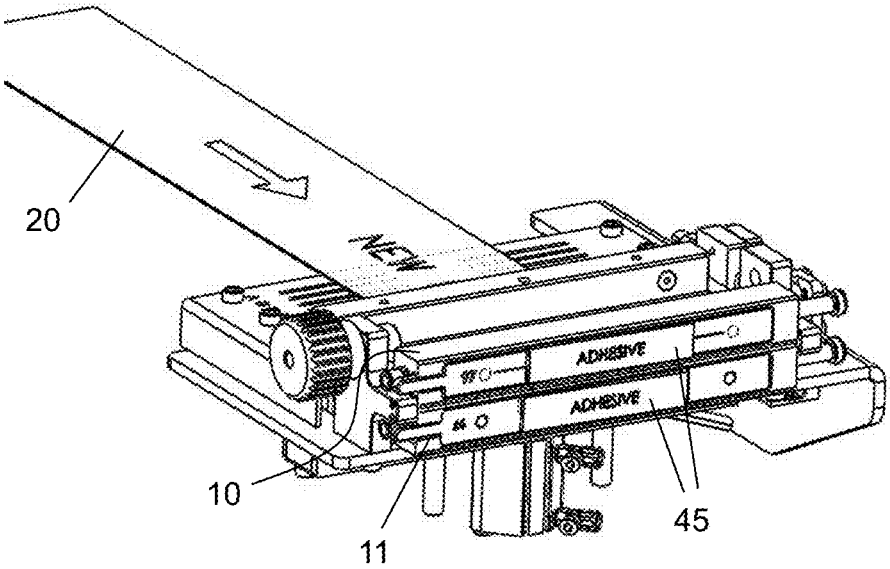
FIG. 3*a* is a perspective view of upper and lower splicer heads comprising an adhesive region in accordance with some embodiments of the presently disclosed subject matter.

It should be appreciated that the presently disclosed subject matter is not limited to tape heads that include a vacuum. Rather, the disclosed system includes any method of retaining tape in place, such as vacuum as well as providing an adhesive surface and/or the use of mechanical clips. For example, FIG. 3*a* illustrates one embodiment of an apparatus comprising upper and lower tape heads 10, 11, each comprising adhesive region 45 (instead of vacuum apertures 43). The term "adhesive region" refers to an area where a weak adhesive has been applied. Suitable weak adhesives can be selected from one of more rubber-based adhesive, acrylic emulsion adhesive, hot melt adhesive, solvent based adhesive, water based adhesive, adhesive silicon, or any other suitable adhesive. In some embodiments, the adhesive region has an adhesive release value of less than about 0.5, 0.4, 0.3, 0.2, or 0.1 pounds per square inch along an adhesive axis.

The inclusion of an adhesive region on the tape head front faces can offer benefits when compared to the use of vacuum apertures 43. For example, the use of adhesive region 45 to hold the adhesive material (tape 30) requires no energy, compared to the significant energy expenditure required for use of a vacuum. Further, vacuums tend to be loud, such that the use of adhesive region 45 provides a more desirable work environment, free from excessive loud noises. In a situation where power is lost, use of the adhesive region would advantageously allow the new and old film splice operation to continue. With the use of a vacuum, if power is lost, the films may also be destroyed or rendered inoperable.

Figure 3B:
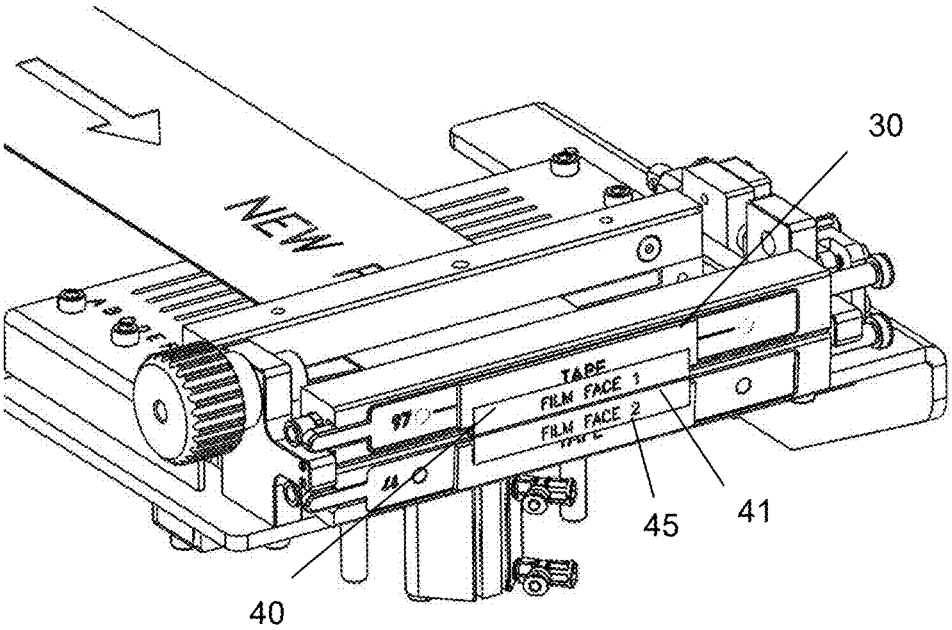
FIGS. 3*b* and 3*c* are perspective views of upper and lower splicer heads with the leading edge of a ready film roll in position for an overlapped splicing operation in accordance with some embodiments of the presently disclosed subject matter.

The adhesive region can be applied to front face 25 of each tape head using any suitable mechanism. The adhesive region can have a thickness of about 0.0001-0.1 inches in some embodiments. The adhesive release value is a measurement of the force required to release a portion of tape 30 from adhesive region 45. The adhesive region can be used to lightly and temporarily attach tape 30 to the front face of each tape head, as shown in FIG. 3*b*. The adhesive region therefore holds tape 30 temporarily in place adjacent the tape head front faces 25. The tape can be attached to adhesive region 45 but can also be removed from the adhesive region without causing any type of material damage or change to the tape (e.g., no adhesive residue is transferred). Thus, the weak adhesive region is configured for non-permanent attachment of the associated tape in some embodiments.

Any mechanism can be used to hold the adhesive strip (e.g., tape 30) on the front face of each tape head before coupling it to the splice joint (e.g., the apparatus is not limited to the use of vacuum suction or adhesive region 45).

Figure 3C:
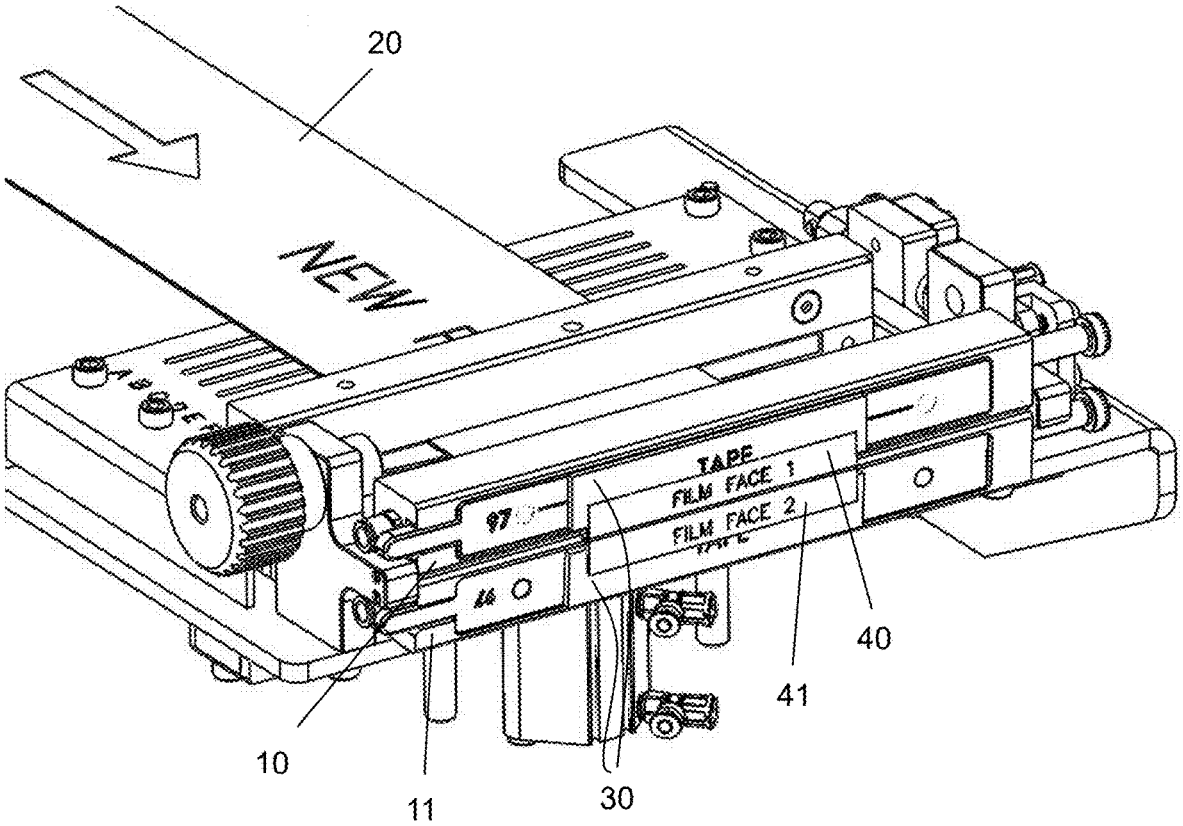

In use, a knife assembly 35 prepares the end of the expiring roll. The leading edge of the new roll is prepared by the operator. Specifically, the leading edge of the new roll is fed through opening 15 between tape heads 10, 11. Because the web is tubular, the side edges of the film are slit by the operator, thereby creating a portion of separated upper and lower films 40, 41 at the leading edge of the new film, as shown in FIG. 3*c*.

The cutting element can include any element capable of cutting film, such as (but not limited to) a knife, razor, laser, and the like. The split new film leading edge is then extended through opening 15 between the upper and lower tape heads. As shown in FIG. 3*c*, separated upper and lower films 40, 41 are positioned adjacent to the front faces of the upper and lower tape heads, respectively, via vacuum suction, adhesive region 45, mechanical clips, or any other suitable method. Films 40, 41 are maintained in position by adhesion to the sticky side of adhesive tape 30.

In some embodiments, the operator can position the upper and lower films against the adhesive tape 30. In other embodiments, the positioning of the upper and lower films can be automated.

Figure 4A:
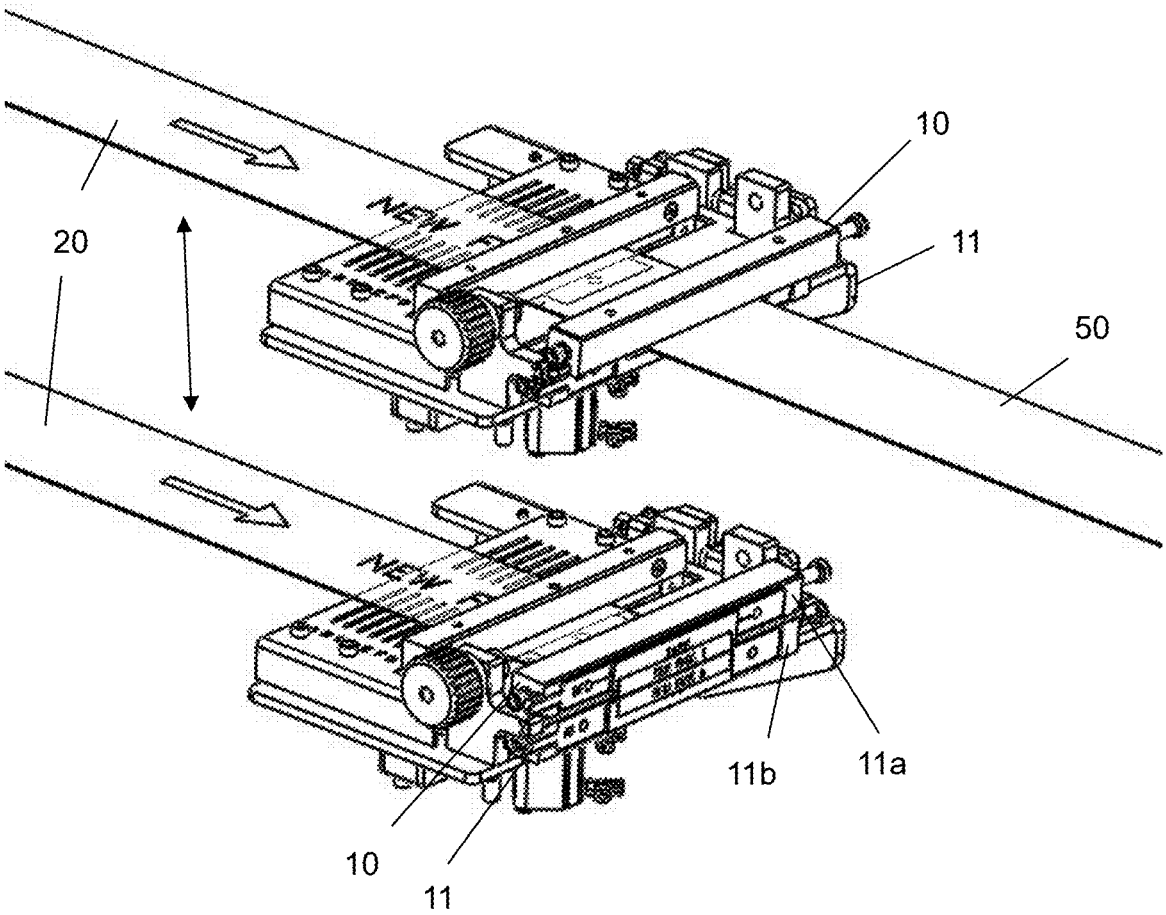
FIGS. 4*a*-4*f* are perspective views of a vertical splicing action in accordance with some embodiments of the presently disclosed subject matter.
Figure 4B:
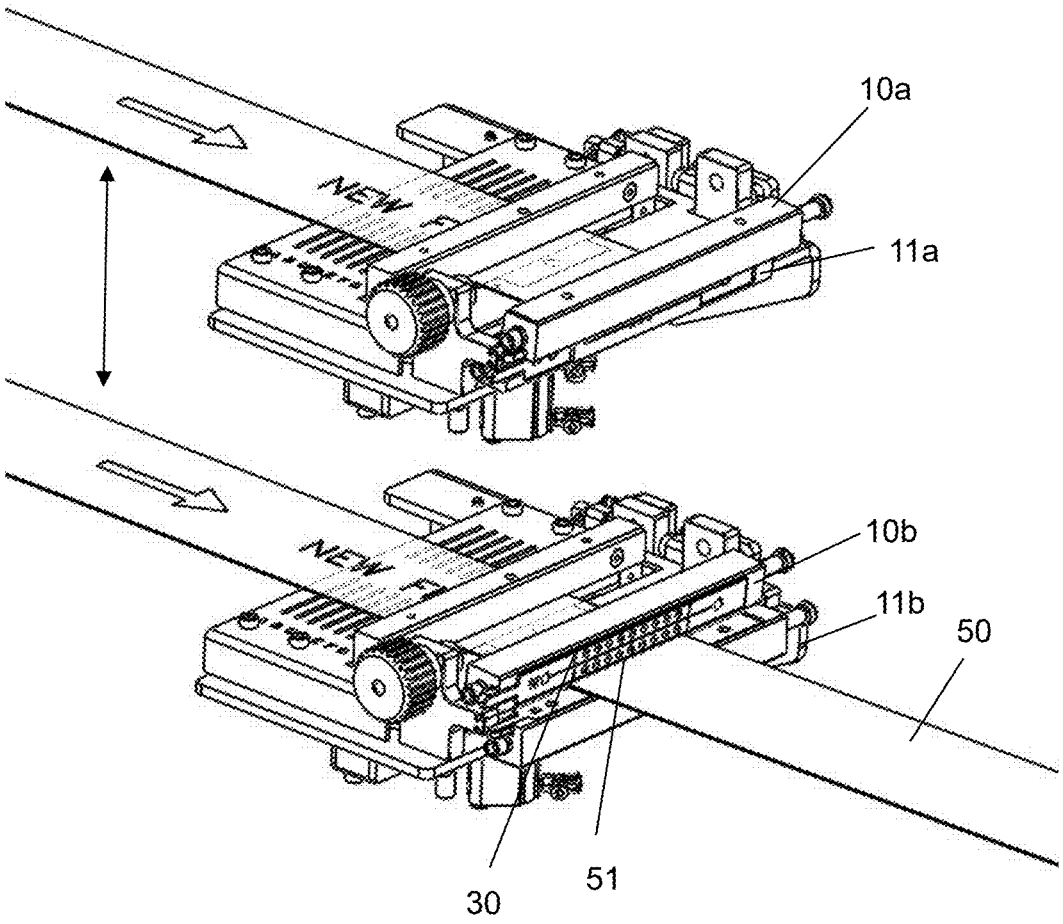
Figure 4C:
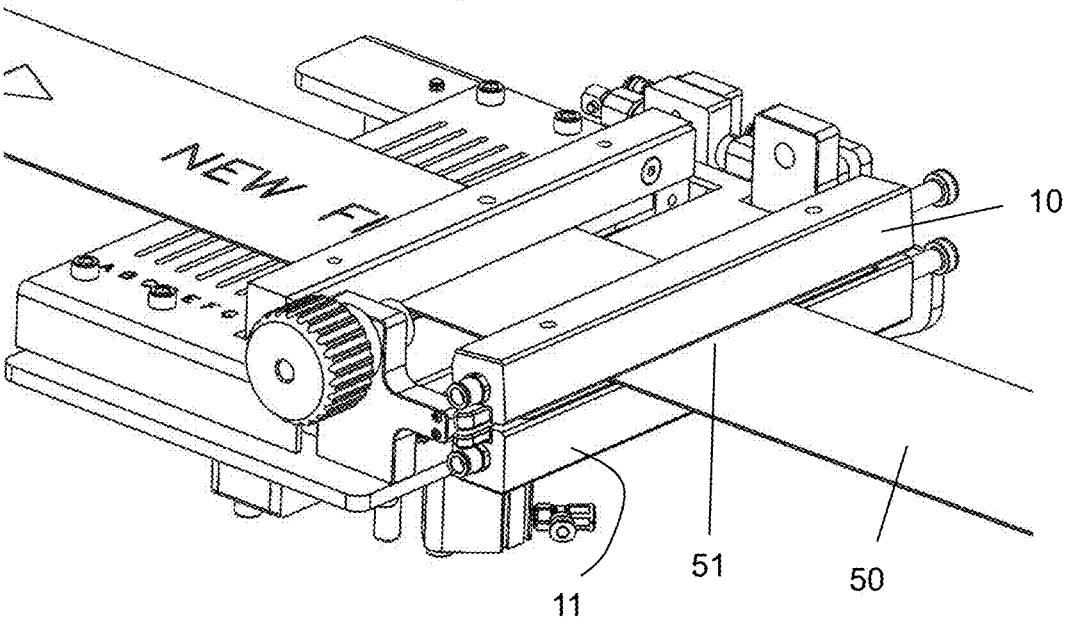

The leading edge (film layers 40, 41) of new film 20 is now in proper position for splicing to the old film 50. When the old roll 50 has expired or is close to expiring (determined by methods well known in the art), the web is cut and then moved into position in close proximity to the prepared splice of the new roll, as shown in FIG. 4*a*. The splicing operation can be accomplished using a pair of upper and lower tape heads in a vertical orientation (separated only to illustrate detail). As shown in FIGS. 4*b* and 4*c*, leading edge 51 of old film 50 can be moved vertically downward to be positioned adjacent to the first tape head pair. The upper tape head 10 then moves relative to the lower tape head 11 to apply tape 30 the top face of leading edge 51 of old film 50. Lower tape head 11 remains stationary. The upper tape head 10 then moves to the starting position after the tape is applied.

Figure 4D:
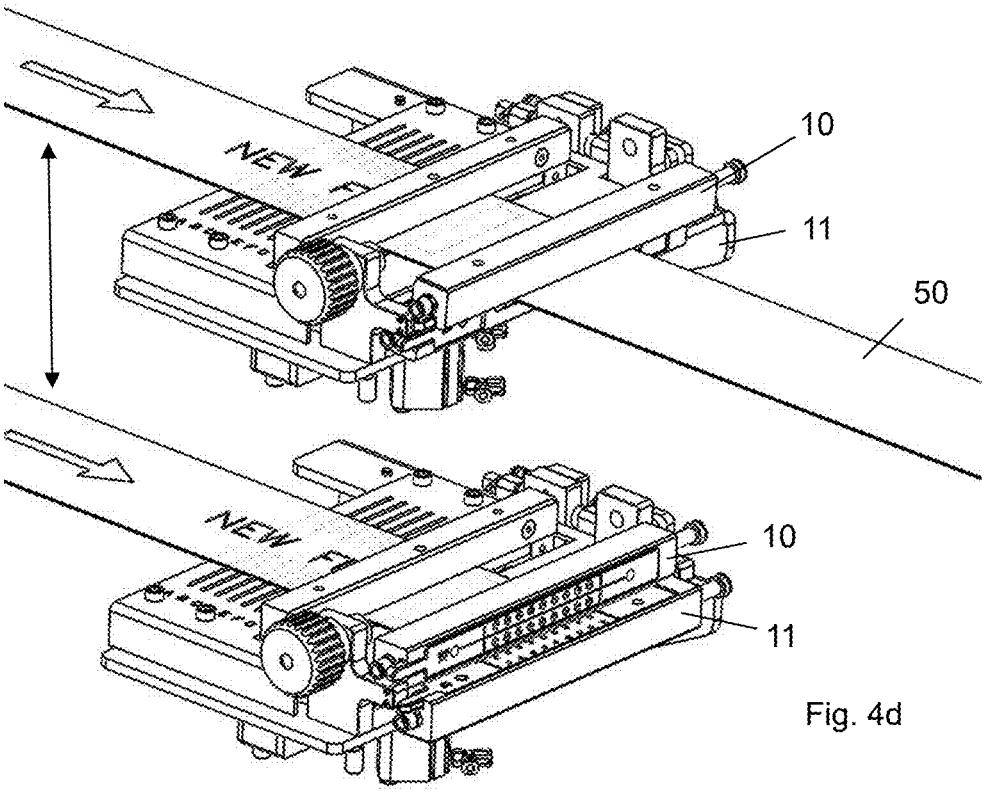
Figure 4E:
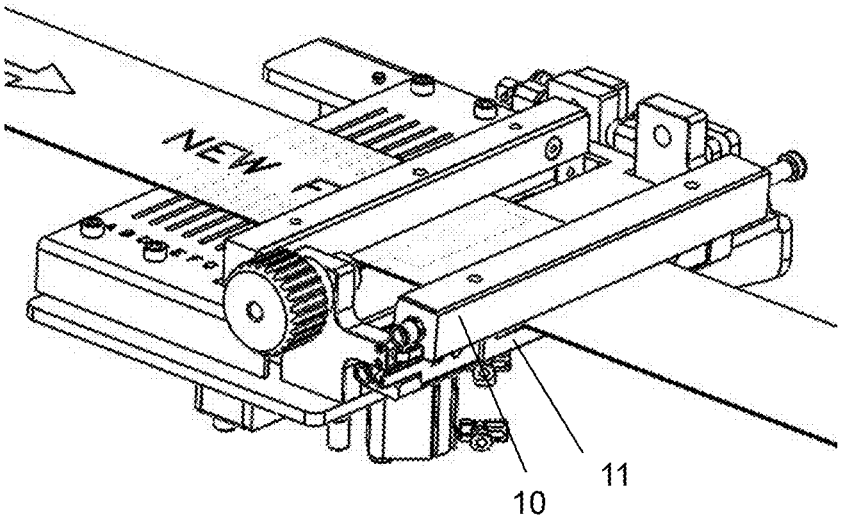
Figure 4F:
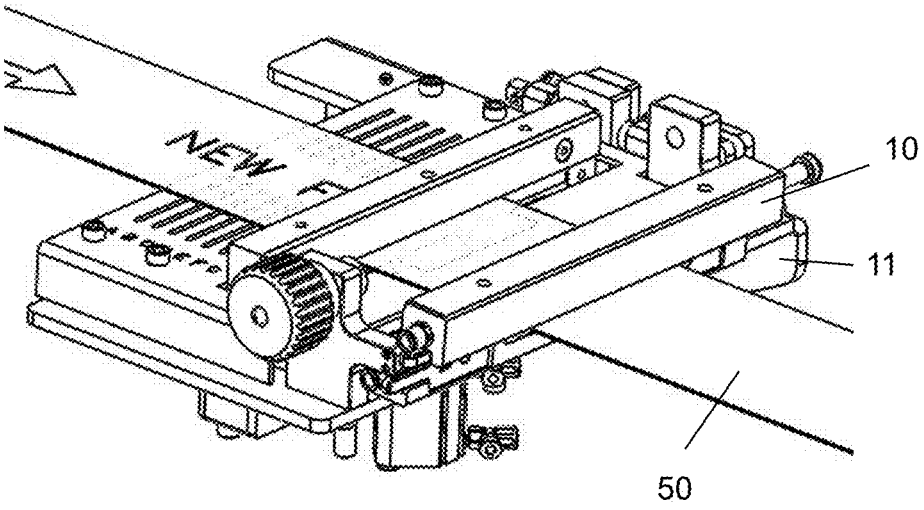

In the next splice sequence, the trailing edge of old film then moves vertically upward and is positioned between the second set of upper and lower tape heads, as shown in FIGS. 4*c* and 4*d*. Lower tape head 11 head rotates or moves to apply tape to the lower face of the leading edge of old film 50. The upper tape head remains stationary, as shown in FIGS. 4*e* and 4*f*. The lower tape head then moves to the starting position.

In some embodiments, the upper and/or lower tape heads can move independently (only one of the tape heads moves at a time). In some embodiments, each tape head can move about 45-135 degrees (e.g., at least/no more than about 45, 50, 55, 60, 65, 70, 75, 80, 85, 90, 95, 100, 105, 110, 115, 120, 125, 130, or 135 degrees) relative to the other tape head that remains stationary.

It should be appreciated that the disclosed system is not limited to two pairs of tape heads arranged in a vertical or horizontal arrangement. Rather, any suitable number of tape heads can be used (e.g., 1, 2, 3, 4, 5, 6, or more).

As the upper and lower sections of each of the upper and lower tape heads move, the trailing edge of the old film 50 is pressed onto the adhesive tape strips 30. As a result, the spliced ends 40, 41 of new film 20 are adhered (via the tape) around the exterior surface of the old film trailing end. The portion of tape 30 positioned on the front face of the upper tape head is adhered to the top face of the old and new films at the splice joint. The portion of tape positioned on the front face of the lower tape head is adhered to the bottom face of the old and new films at the splice joint. Thus, the old film is positioned within the interior of the new film and maintained via tape 30 via a "trailing edge-in" splice method. Stated another way, the trailing edge of the old film is inserted with the interior of the new film at the new film leading edge, creating a small and overlapped transitioned area 45. As the spliced film passes over the shrink sleeve applicator tooling, positioning the old film inside the new film allows for a smooth transition from one section to the next. In contrast, if the new film were inserted into the old, it would allow the edge of the inner splice to catch on the tooling as it is pulled over, increasing the chance of tearing the film.

Figure 5:
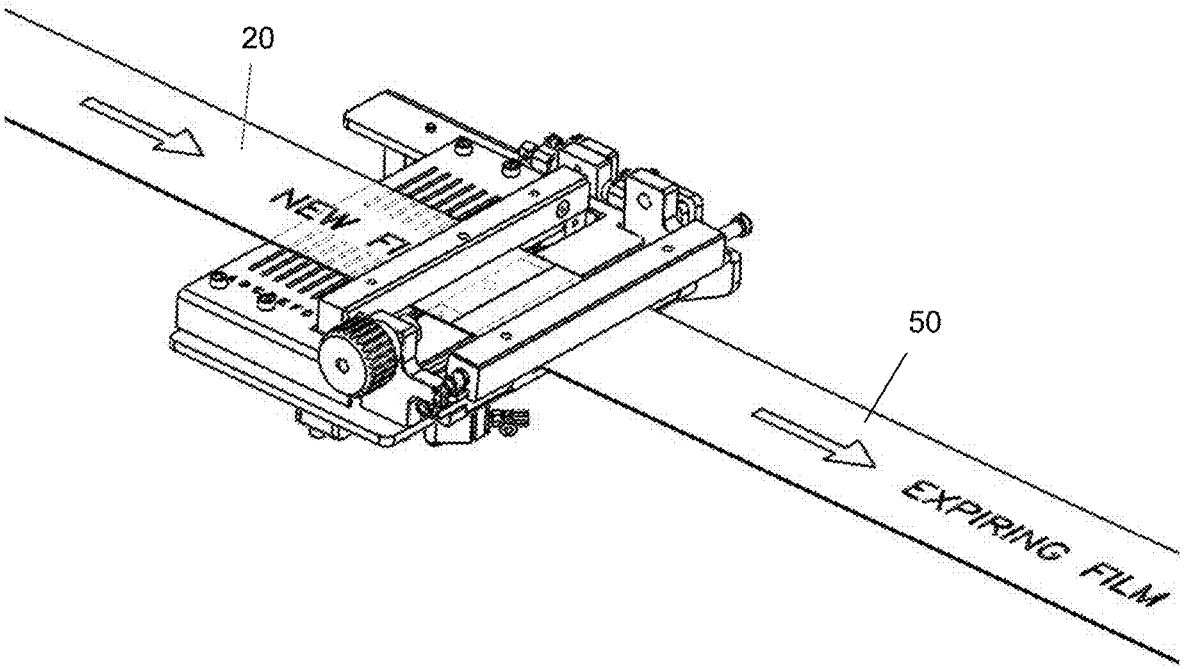
FIGS. 5 and 6 are perspective views of a splicer head after an overlapped splicing operation has been performed in accordance with some embodiments of the presently disclosed subject matter.
Figure 6:
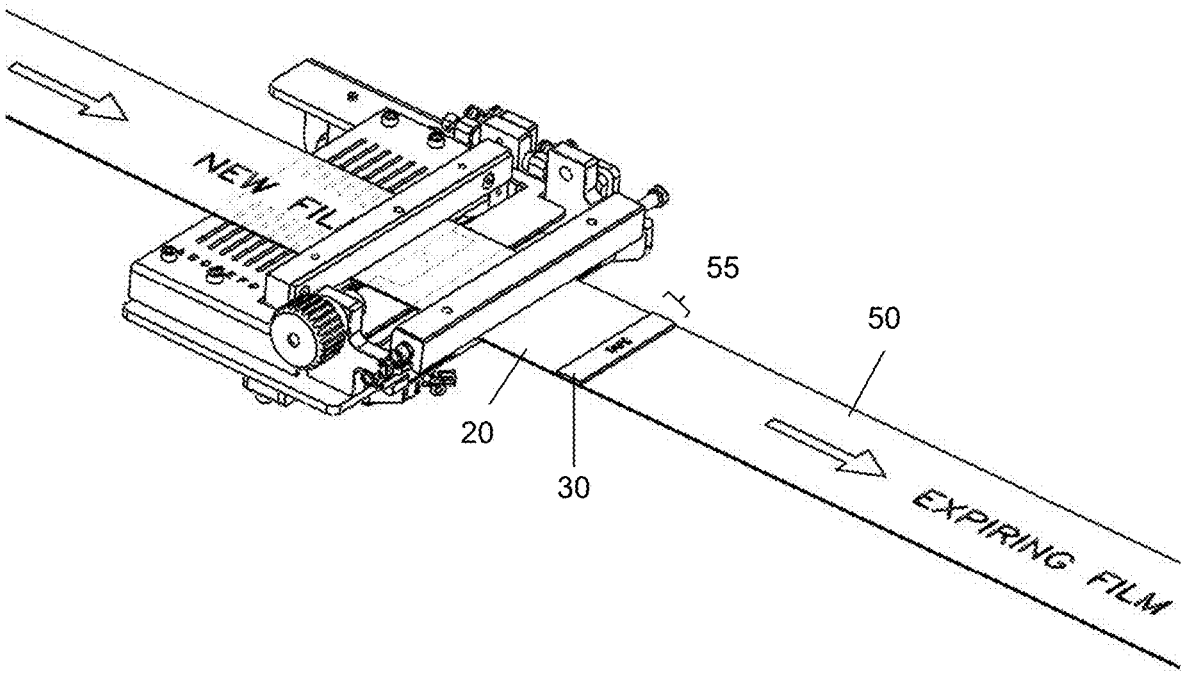

The upper and/or lower tape head are then rotated back to the original position, as shown in FIG. 5. The new film is then advanced seamlessly, as shown in FIG. 6. The overlapping area 55 of the spliced film is then maintained in contact with each other via the tape.

Turning now to FIG. 6, one method of splicing a new roll of tubular web into an old roll of tubular web is shown. The disclosed method can include first preparing a new roll of tubular web for splicing. The new roll can be prepared by positioning tape on the front faces of the upper and lower splicer tape heads of an associated splicer head. The tape can be positioned on the front face of each tape head using vacuum holes 43 or any other mechanism, such as adhesive region 45. A cutting device is used by the operator to split the sides of the leading edge of the new film, thereby creating upper and lower split films 40, 41. The leading edge can be split into upper and lower films before or after the leading edge of the new film is advanced through the opening between the upper and lower tape heads. The upper split web is then positioned against a portion of tape held on the upper tape head, and the lower split web is positioned against the adhesive portion of tape held on the lower tape head.

After the new film is prepared, the method includes preparing the old roll of film for splicing. Specifically, the trailing edge of the old film is cut and positioned adjacent to the prepared new roll of film.

Figure 7:
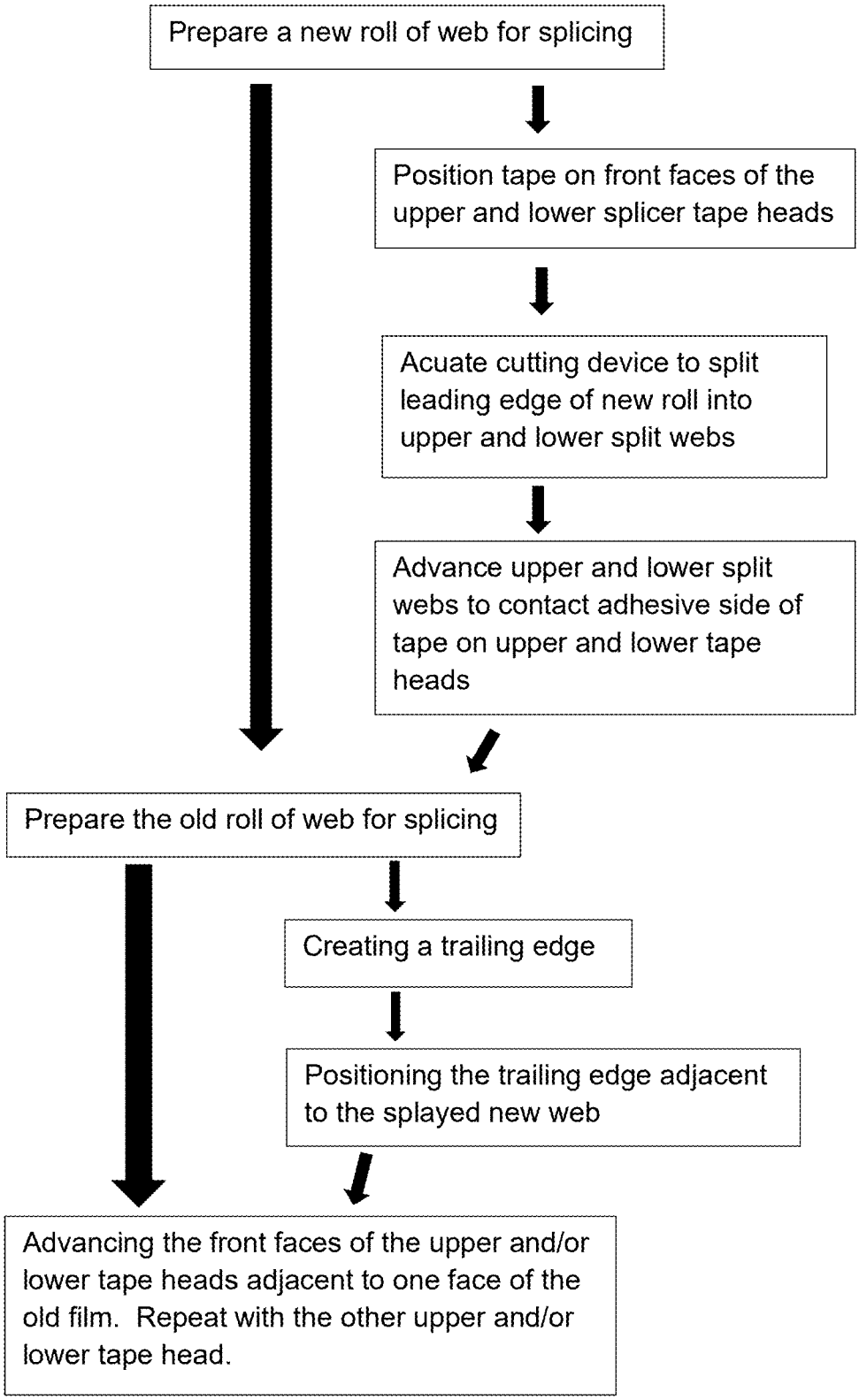
FIG. 7 is a schematic illustrating one method of using the disclosed splicing head in accordance with some embodiments of the presently disclosed subject matter.

As shown in the schematic of FIG. 7, after the new web and old web are prepared for splicing, the front faces of the splice head upper and/or lower tape heads are positioned to an abutting (facing) position that contacts one side of the old film leading edge. As a result, the adhesive portion of tape positioned on the upper tape head is adhered to the top face of the old film at the trailing edge and is also adhered to the upper splayed portion of the new film. In this way, the upper film of the new web leading edge is adhered to the top face of the old film. Similarly, the adhesive portion of tape positioned on the lower tape head is adhered to the bottom face of the old film at the trailing edge and is also adhered to the lower splayed portion of the new film. Accordingly, the new film leading edge is spliced to the trailing edge of the old film (e.g., the trailing edge is positioned within the interior of the new web at the leading edge). The spliced film can then be used, becoming the new film for the desired manufacturing activity. The spliced film can be drawn towards the festoon to continue with operations seamlessly and without ceasing operations of the line.

Advantageously, the disclosed splicing apparatus allows splicing of the old and new films to be performed without interrupting the running of the shrink sleeve applicator, and therefore provides for efficient splicing with little to no lost production time.

Because the splice can be performed while the shrink sleeve applicator is running, the disclosed apparatus allows for increased throughput and minimal revenue loss.

Additionally, the splice can be performed automatically without human interaction once the new roll has been prepared. Devices, systems, and methods of the present disclosure may create a stable splice capable of passing through additional rollers or other equipment without issue. For example, a splice of the disclosed apparatus is formed as an overlapped splice, thus reducing issues caused by butt splices (e.g., gaps or exposed tape).

Accordingly, the disclosed apparatus and method is especially suitable for use in the packaging industry, although not being limited to that application.

The disclosed splicer is relatively compact and has a small footprint.

The disclosed splicer minimizes the amount of misaligned web delivered to a downstream web-consuming machine following each splice.

The disclosed apparatus and method allows for easy, efficient, and convenient splicing of two webs.

The disclosed splicer produces high quality overlapped splices between webs on a consistent basis.

The present invention has been described in accordance with various illustrative embodiments. However, it is expressly contemplated that the principles of the present invention may be implemented in a plurality of alternative embodiments. The various components and their orientations in exemplary splicing apparatus may be varied dependent on implementation requirements. For example, while an upper roll and lower roll have been described and shown, the principles of the present invention may be utilized with rolls in differing orientations, e.g., side by side. Therefore, the various descriptions of operations, the order in which they are performed, particular components

What is claimed is:

1. A tubular film splicing apparatus defined by:

an upper tape head comprising a front face that includes a first attachment element;

a lower tape head comprising a front face that includes a second attachment element;

an opening positioned between the upper and lower tape heads;

a cutting element;

wherein the upper tape head and the lower tape head each move between a first orientation in which the front face extends in a first direction, and a second orientation in which the front face is positioned to face the other tape head, wherein the upper tape head and the lower tape head move; and a shuttle configured to move between a first set of upper and lower tape heads and a secondary set of upper and lower tape heads.

2. The tubular film splicing apparatus of claim 1, wherein the cutting element is selected from a knife, blade, or laser.

3. The tubular film splicing apparatus of claim 1, further comprising an actuator to provide the movement of the upper and lower tape heads.

4. The tubular film splicing apparatus of claim 1, wherein the upper and lower tape heads move about 90 degrees.

5. The tubular film splicing apparatus of claim 1, wherein the first and second attachment elements are selected from a vacuum, an adhesive region, a mechanical clip, or combinations thereof.

6. A method of creating an overlapping joint of two tubular films, the method comprising:

positioning a first portion of tape defined by an adhesive side and a non-adhesive side on the front face of the upper tape head of claim 1 such that the non-adhesive side contacts the first attachment element on the front face of the upper tape head;

positioning a second portion of tape defined by an adhesive side and a non-adhesive side on the front face of the lower tape head such that the non-adhesive side contacts the second attachment element on the front face of the lower tape head;

feeding a leading edge of a first tubular film through the opening between the upper and lower tape heads;

cutting the leading edge of the first tubular film using the cutting element to create an upper portion of film and a lower portion of film either before or after feeding the first tubular film through the opening;

advancing the upper portion of film and lower portion of film of the first tubular film between the first and second tape heads such that the upper portion of film contacts the adhesive side of the first portion of tape and the lower portion of film contacts the adhesive side of the second portion of tape;

positioning the trailing edge of a second tubular film in alignment with the first tubular film;

using a shuttle to position the trailing edge of the second tubular film between a first set of upper and lower tape heads and a secondary set of upper and lower tape heads;

moving either:

the front face of the upper tape head from the first orientation to the second orientation, whereby the adhesive side of the first portion of tape is adhered to a top face of the second tubular film; or the front face of the lower tape head from the first orientation to the second orientation, whereby the adhesive side of the second portion of tape is adhered to a bottom face of the second tubular film;

whereby the first tubular film and second tubular film are spliced via an overlapping joint wherein the trailing edge of the second tubular film is aligned within an interior of the first tubular film.

7. The method of claim 6, wherein the tubular film splicing apparatus is used with shrink sleeve applicator machinery, and wherein the machinery continues to run while the overlapping joint is created.

8. The method of claim 6, wherein the first tubular film is a new roll of a film, and the second roll of film is an expiring roll of film.

9. The method of claim 6, wherein the first tubular film and the second tubular film are shrink films.

10. The method of claim 6, wherein the first tubular film and the second tubular film are multilayer polymeric films.

11. A tubular film splicing apparatus defined by:

an upper tape head comprising a front face that includes a first attachment element;

a lower tape head comprising a front face that includes a second attachment element;

an opening positioned between the upper and lower tape heads;

a cutting element configured to cut a trailing edge of a film that passes through the opening positioned between the upper and lower tape heads;

a gap between the cutting element and the upper and lower tape heads; and a shuttle configured to move between a first set of upper and lower tape heads and a secondary set of upper and lower tape heads.

12. The tubular film splicing apparatus of claim 11, wherein the cutting element is selected from a knife, blade, or laser.

13. The tubular film splicing apparatus of claim 11, further comprising an actuator to provide the movement of the upper and lower tape heads.

14. The tubular film splicing apparatus of claim 11, wherein the upper and lower tape heads move about 90 degrees.

15. The tubular film splicing apparatus of claim 11, wherein the first and second attachment elements are selected from a vacuum, an adhesive region, a mechanical clip, or combinations thereof.

* * * * *